United States Patent [19]

Selleck

[11] 4,446,461

[45] May 1, 1984

[54] INSTRUMENTATION FOR A ROTARY MACHINE

[75] Inventor: Franklin G. Selleck, Portland, Conn.

[73] Assignee: United Technologies Corporation, Hartford, Conn.

[21] Appl. No.: 317,632

[22] Filed: Nov. 2, 1981

[51] Int. Cl.[3] ..... G08C 19/06; H01F 15/02; H01F 21/04

[52] U.S. Cl. ..... 340/870.32; 336/83; 336/115; 336/120; 340/870.01

[58] Field of Search ..... 340/870.32, 870.34, 340/870.31, 870.01; 336/83, 120, 115

[56] References Cited

U.S. PATENT DOCUMENTS

| | | | |
|---|---|---|---|
| 2,962,679 | 11/1960 | Stratton | 336/83 |
| 3,068,433 | 12/1962 | Wroblewski et al. | 336/83 |
| 3,202,948 | 8/1965 | Farrand | 336/115 |
| 3,325,760 | 6/1967 | Bernard | 336/83 |
| 3,668,585 | 6/1972 | Johnson | 336/83 |
| 4,354,190 | 10/1982 | Reschovsky | 340/870.32 |

*Primary Examiner*—James J. Groody
*Attorney, Agent, or Firm*—Gene D. Fleischhauer

[57] ABSTRACT

A rotor telemetry apparatus 60 for providing a data communication link between a rotating member 68 and a stationary member 66 of a rotary machine is disclosed. The rotor telemetry apparatus includes a pair of coils 72 each mounted on an associated member for transferring electrical energy between the stationary member 66 and rotating member 68 of the turbomachine. At least one coil of the pair of coils is held by a first layer 88 of bonding agent and is attached to one of the members by a second layer 90 of bonding agent which is filled with a magnetizable material having a magnetic permeability under operating conditions that is greater than the magnetic permeability of the bonding agent. A method of assembling the coils to the stationary and rotating members is also disclosed. In one embodiment a pair of cooperating antennas 70 are disposed between the cooperating coils and spaced by a portion of the first layer containing the coils away from the second layer of bonding agent filled with a magnetizable material.

10 Claims, 3 Drawing Figures

INSTRUMENTATION FOR A ROTARY MACHINE

DESCRIPTION

1. Technical Field

This invention relates to rotary machines and in particular to the installation of a rotor telemetry system to the rotating and stationary elements of the machine for transferring electrical energy between these elements.

2. Background Art

A rotary machine is any machine having an important component that rotates about an axis. In a rotary machine such as an axial flow gas turbine engine the major component rotating about an axis of rotation is the rotor assembly. The rotor assembly extends axially through the engine. A stator assembly circumscribes the rotor assembly. The stator assembly supports the rotor assembly and in conjunction with the rotor assembly bounds an axially extending flow path for working medium gases.

The temperatures and pressures of the working medium gases are two operating parameters which affect operating variables such as pressures, temperatures, and stresses in components of the engine. These operating parameters and variables are monitored during development of the engine and after development of the engine to control engine operation and to gather data about the performance of the engine. Sensors such as strain gauges for stresses and thermocouples for temperatures are used as detectors to detect desired inputs and as transducers to provide analogous outputs. The analogous outputs are transferred through a data communication link to an intermediate modifying stage and thence to a terminating stage such as an indicator, a recorder or a controller. A data communication link between a sensor mounted on a stator element and an intermediate modifying stage such as an FM receiver might be as simple as a coaxial cable. For a sensor on a rotating unit, the data communication link must transfer data in the form of electrical energy from a rotating structure having a rotational speed of many thousands of revolutions per minute to a link mounted on the stator structure such as a coaxial cable, and connected to the intermediate modifying stage.

One data communication link between rotor and stator structures is a radio frequency transmitter on the rotating structure having an antenna on the rotating structure and a cooperating antenna on the stator structure for transferring electrical energy between the structures. Electrical power is provided to the transmitter from a power supply via a pair of electrical coils. One of the coils is mounted on a stationary member and one of the coils is mounted on the rotating member. These antennas and coils may each be mounted by layers of a bonding agent. The resulting structure fixes the antenna and coils in space and attaches these components to the stationary and rotating members in a satisfactory fashion. However, undesirable heating during the transfer of electrical power from the electrical coil on the stator structure to the electrical coil on the rotor structure and thence to the transmitter may adversely affect the electrical life of the components, the fatigue life of the support members, and the effective life of the bonding agent with failure of any of these components disrupting operation of the engine. For example should the bonding agent fail during rotation of the rotor shaft, the bonding agent would fly away from the shaft into the adjacent cavities disrupting the data communication link and possibly causing damage to the engine. As a result scientists and engineers are seeking ways to mount the power transmitting coils and the antennas to the rotating and stationary structure in a simple manner such as through the use of an epoxy resin and yet in a way which avoids many of the problems outlined above.

DISCLOSURE OF INVENTION

According to the present invention, a coil of a pair of coils for transferring electrical energy between stationary and rotating members of a rotary machine is held by a first layer of bonding agent and is attached to one of the members by a second layer of bonding agent which is spaced from the coils and which is filled with a magnetizable material having a magnetic permeability greater than the magnetic permeability of the bonding agent to modify the coupling of the flux linkage between the coils.

In accordance with one embodiment, two first layers of bonding agent each containing a cooperating coil and antenna for transferring power and telemetry signals, are each supported from an associated member of the rotary machine by an associated second layer of bonding agent filled with a magnetizable material such that the magnetizable material radially brackets the coils and the coils radially bracket the antennas.

A primary feature of the present invention is a member of a pair of members of a rotary machine capable of relative rotational movement. Two layers of bonding agent are attached to one of the members. An electrical coil for transferring electrical power is held in the first layer. The second layer of bonding agent attaches the first layer to the member and spaces the electrical coil from the member. The layer of bonding agent is filled with a magnetizable material having a magnetic permeability greater than the permeability of the bonding agent. In one embodiment, first layers of bonding agent are attached to the members by second layers of bonding agent each extending between a first layer and an associated member. The first layers are spaced radially one from the other. One antenna of a pair of cooperating antennas is disposed in each first layer. One coil of a pair of electrical coils for transferring electrical power is disposed in each first layer. Each coil is spaced radially from the associated member of the rotary machine by the second layer. The coils bracket radially the antennas. Each second layer of bonding agent is spaced radially from the antennas by the first layer. Each second layer of bonding agent is filled with a magnetizable material having a magnetic permeability greater than the magnetic permeability of the bonding agent. The magnetizable material radially brackets the coils and the coils bracket the antennas.

A principal advantage of the present invention is the efficient transmission of electrical power between a pair of electrically cooperating coils which results from the coupling of the magnetic flux linkages. The electrical life of the components, the fatigue life of the members, and the effective life of the bonding agent are prolonged by reducing eddy currents (and thus undesirable induction heating) in the rotary machine members as compared with structures using bonding agents that are not filled with a magnetizable material having a magnetic permeability greater than that of the bonding agent. The adverse impact of the weight of the bonding agent on engine operation and of the radial profile of the data communication link on engine design is similarly reduced as compared with structures relying on a bonding agent having a smaller magnetic permeability. Electrical interference caused by the magnetic permeability of the second layer is avoided by spacing the antenna away from the second layer with the first layer.

The foregoing, and other objects, features and advantages of the present invention will become more apparent in the light of the following detailed description of the preferred embodiment thereof as shown in the accompanying drawing.

BEST MODE FOR CARRYING OUT THE INVENTION

Figure 1:
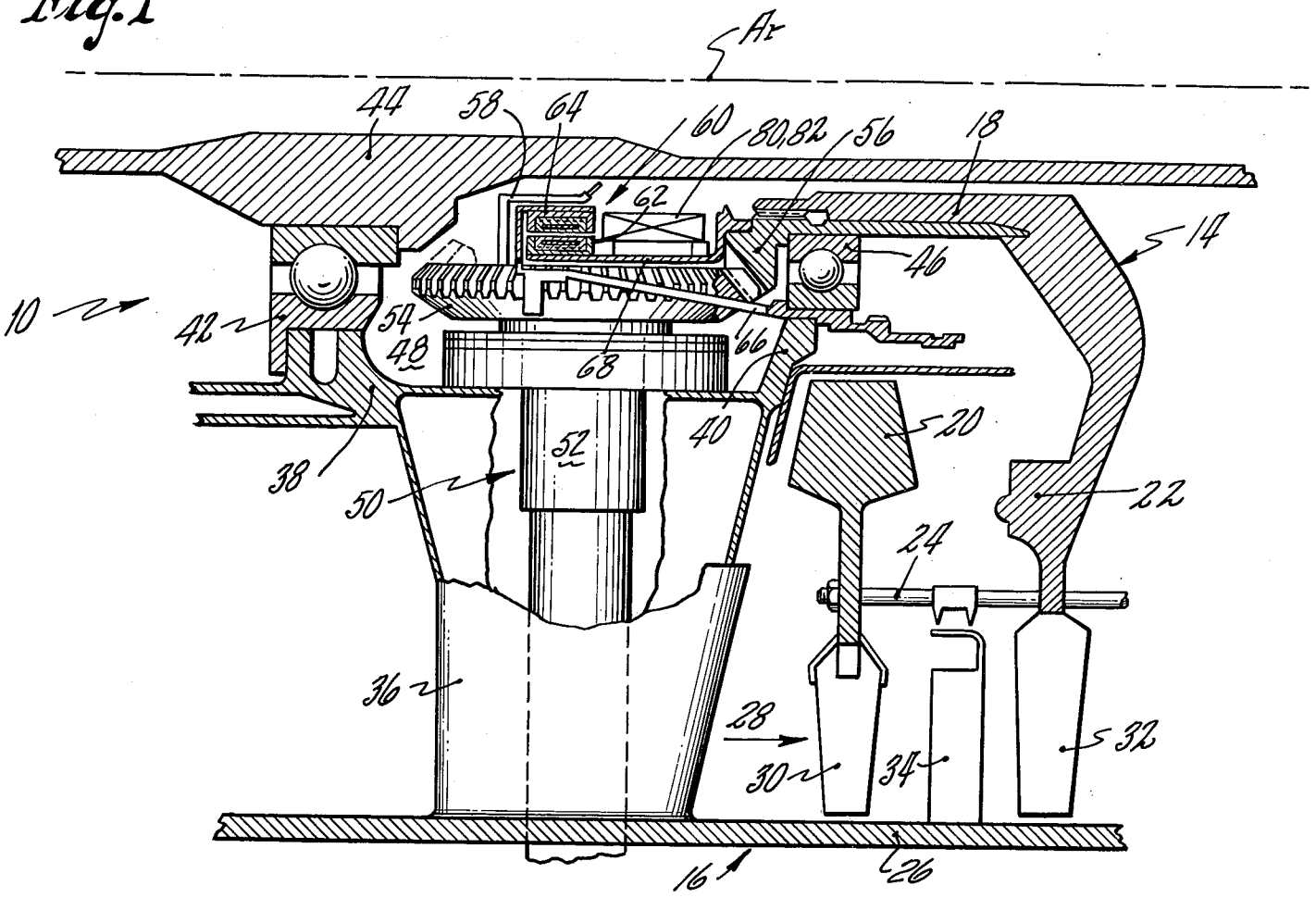
FIG. 1 is a cross sectional view of a portion of the compression section of a gas turbine engine.

FIG. 1 illustrates a gas turbine engine embodiment of the present invention. The gas turbine engine is a rotary machine having a turbine section and a compression section. A portion of the compression section 10 is shown. The compression section has a rotor assembly 14 extending axially about an axis of rotation $A_r$ and a stator assembly 16 extending axially to circumscribe the rotor assembly.

The rotor assembly 14 includes a rotor shaft 18 and a plurality of rotor disks, as represented by the rotor disks 20 and 22. A spacer 24 extends between the rotor disks. The rotor disks and spacers are bolted together and are joined to the rotor shaft. The stator assembly 16 includes an outer case 26 spaced radially from the rotor assembly. A working medium flow path 28 is bounded by the outer case and the rotor assembly. An array of rotor blades at each disk, as represented by the single rotor blade 30 and the single rotor blade 32, extend outwardly at each rotor disk across the working medium flow path into proximity with the outer case. An array of stator vanes 34 extends inwardly from the outer case across the working medium flow path into proximity with the rotor assembly. A strut 36 extends inwardly from the outer case across the working medium flow path and terminates in a first support ring 38 and a second support ring 40. A first bearing 42 is supported by the first support ring. An inner rotor shaft 44 inwardly of the rotor shaft 18 has the same axis of rotation $A_r$ as does the rotor shaft 18. The inner rotor shaft is supported by the first bearing. A second bearing 46 is supported by the second support ring 40. The second bearing supports the rotor shaft 18. A circumferentially extending cavity 48 is defined by the first support ring 38, the circumferentially extending first bearing 42, the cylindrical inner rotor shaft 44, the cylindrical rotor shaft 18, the circumferentially extending second bearing 46 and the second support ring 40. A tower shaft 50 disposed in the cavity has a cylindrical shaft 52 which extends outwardly through the hollow strut 36. A bevel gear 54 on the tower shaft engages an associated bevel gear 56 on the end of the rotor shaft 18. An oil supply system, as represented by the conduit 58, supplies oil to the cavity 48. The oil provides lubrication to the bearings and other rotating components and acts as a working medium to remove heat from the cavity.

A rotor telemetry system 60 is installed in the circumferentially extending cavity 48. In order to provide room for the components of the rotor telemetry system, the bevel gear 54 on the tower shaft 52 is modified by removal of a portion of the bevel gear as shown by the broken lines in FIG. 1 to provide an operating clearance between the components of the system and the bevel gear. The components of the rotor telemetry system include a rotor unit 62 and a stator unit 64. A stationary member formed of a plurality of axially extending members circumferentially spaced one from another, as represented by the single member 66, supports the stator unit. A rotating member 68 attached to the rotor shaft extends axially from the rotor shaft to support the rotor unit and the transmitting unit.

Figure 2:
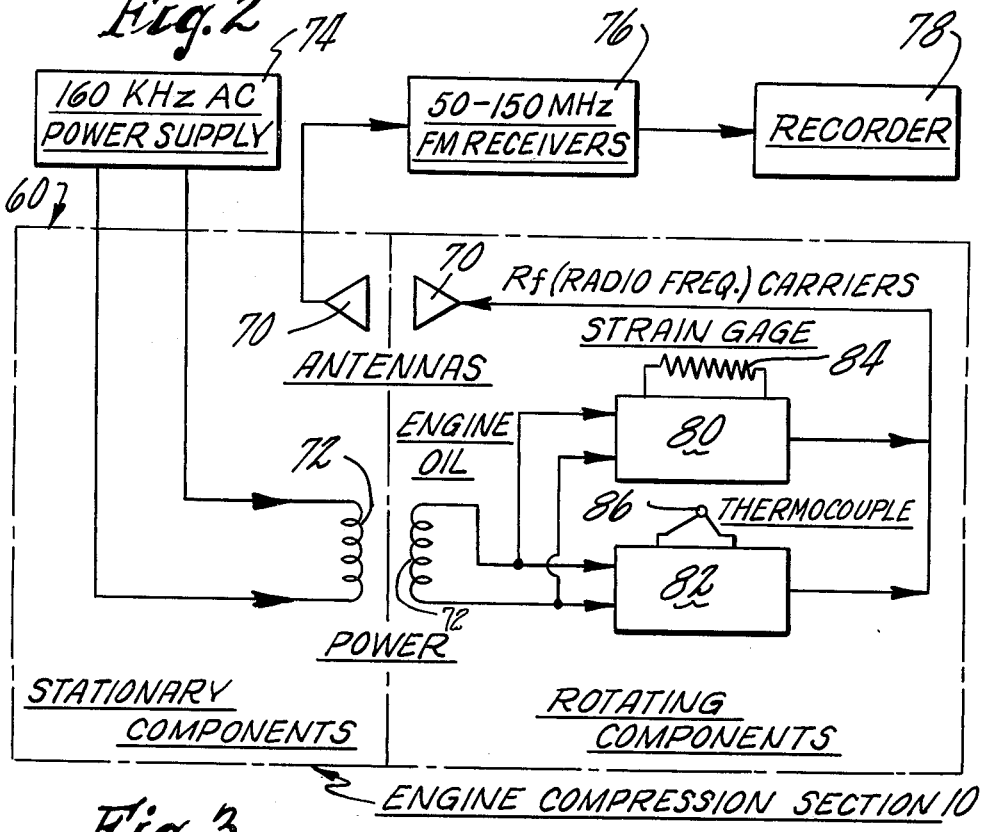
FIG. 2 is a schematic diagram of a rotor telemetry system.

FIG. 2 is a block diagram of the rotor telemetry system 60. The stator unit 64 includes one of a pair of electrically cooperating antennas 70 and one of a pair of electrically cooperating coils 72. The rotor unit carries the second of the pair of cooperating antennas and the second of the cooperating electrical coils. The electrical coil of the stator unit is in electrical communication with a power supply 74 supplying alternating current having a frequency of one-hundred and sixty kilohertz (160 Khz). The antenna of the stator unit is in electrical communication through an FM receiver 76 with a recorder 78. The electrical coil of the rotor unit is in electrical communication with transmitters such as the transmitter 80 and the transmitter 82. The transmitter 80 is in electrical communication with a sensor such as a strain gauge 84. The transmitter 82 is in electrical communication with a sensor such as a thermocouple 86. These sensors may be installed in any location on the rotating unit from which data is desired. The transmitters are in electrical communication with the antenna on the static structure through the cooperating antenna on the rotating structure.

Figure 3:
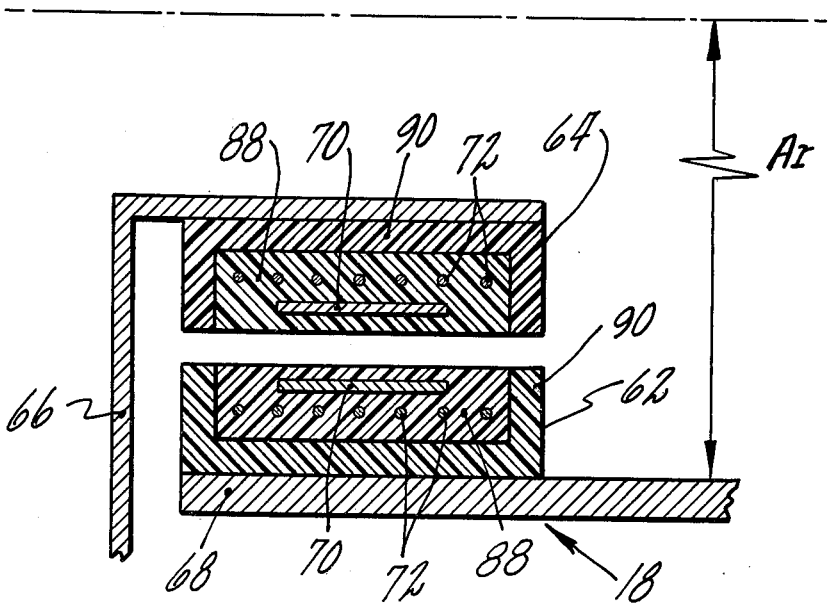
FIG. 3 is an enlarged sectional view of a portion of the compression section shown in FIG. 1 and shows a data communication link mounted to the rotating and stationary structure.

FIG. 3 is an enlarged view of a portion of FIG. 1 showing the stator unit 64 and the rotor unit 62. The stator and rotor units include a first layer 88 of bonding agent and a second layer 90 of bonding agent. The first layer of bonding agent is adapted to be attached to the rotatable shaft 18. One satisfactory bonding agent for the first layer of bonding agent is filled epoxy resin, such as DP-8378-1 material, available from the Conap Corporation, Olean, N.Y. The DP 8378-1 material is filled fifty percent (50%) by weight of the epoxy resin with a ceramic based filler such as Lithofax filler also available from the Conap Corporation. The second layer of bonding agent 90 is radially outwardly of the first layer of bonding agent and extends between the first layer of bonding agent and the rotatable shaft to attach the first layer of bonding agent to the rotatable shaft. One satisfactory bonding agent for the second layer of bonding agent is a filled epoxy resin. This filled epoxy resin is formed by taking an unfilled epoxy resin, such as DP 9563 material distributed by the Conap Corporation and filling the resin with a magnetizable material having a magnetic permeability under operating conditions that is greater than the magnetic permeability of the second layer of bonding agent. One satisfactory magnetizable material is ferrite, a metallic oxide, distributed as CERAMAG® 24B.0244 filler by the Stackpole Corporation, St. Marys, Pa. The CERAMAG® ferrite filler has a relative magnetic permeability characteristic of twenty-five hundred (2500) at an input power frequency of one hundred and sixty kilohertz (160 Khz). Relative magnetic permeability is defined as the ratio of the magnetic permeability of the ferrite to the magnetic permeability of free space where permeability has the units weber ampere$^{-1}$ meter$^{-1}$. The particle size of the filler and the amount of filler must not degrade the bonding performance of the second layer of bonding agent to the extent that separation of the agent from the shaft is possible in the rotational force field of the engine. In addition, the addition of the filler must not make electrically conductive the normally non-conductive bonding agent to the extent that filler eddy currents are generated in the second layer of bonding agent. The CERAMAG® 24B.0244 used to fill the DP 9563 material has a particle size of approximately three thousandths of an inch (0.003 in.) and an amount of filler is used such that for a weight of epoxy resin the amount of filler is less than twenty-five percent (25%) by weight of the epoxy resin. The resulting bonding agent is used with a rotor having a rotational speed of approximately eight thousand revolutions per minute (8000 rpm). As will be realized, more or less filler may be utilized and the particle size may be varied provided the bonding performance of the agent and the non-conductiveness of the agent is not degraded as discussed above.

One satisfactory method of forming either the rotor unit 62 or the stator unit 64 is to first form a first layer 88 of bonding agent in a mold. The mold has the same internal configuration as does the second layer of bonding agent shown in FIG. 3. The mold is formed of circumferentially extending segments attached one to the other. Electrical antennas and coils are disposed in the first layer of bonding agent while the bonding agent is in the mold. The bonding agent is then cured. A bonding agent formed from an epoxy resin is cured by placing the epoxy resin in an environment having a known temperature for a preselected period of time. The first mold is removed from the first layer of bonding agent. A second mold is formed on one of the members, such as the rotating member 68, and the second layer 90 of epoxy resin containing the magnetizable material, such as ferrite, for a filler is placed in the second mold. The first layer of bonding agent containing the electrical coil is attached to the member by placing the first layer of bonding agent which has cured against the uncured second layer 90 of bonding agent and allowing the second layer of bonding agent, such as epoxy resin, to cure. As will be realized, an alternate less preferred method of forming the structure would be to first form a second layer of epoxy resin on the associated member of the rotary machine and to place a first layer of epoxy resin containing the antennas and coils in contact with the second layer of epoxy resin before the first layer of epoxy resin and the second layer of epoxy resin have cured.

During operation of the engine, rotation of the shaft 18 about the axis of rotation $A_r$ causes working medium gases to be forced through the compression section 10 of the engine along the working medium flow path 28. Operation of the engine causes changes in temperature and changes in stresses in the operating components including those components bearing strain gauges and thermocouples. Electrical signals from these sensors which are analogous to the sensed temperature or stresses are transmitted via a short range ratio frequency link which includes transmitters, such as transmitters 80 and 82 and the cooperating antennas 70, to a bank of FM receivers 76 for demodulation and conditioning. The power supply 74 provides power for the transmitters and the sensors through the electrically cooperating coils 72. The coils act as a transformer in which the primary winding coil is stationary and the secondary winding coil rotates. The magnetizable material such as ferrite in the second layer brackets the first layer and thus the coils and the antennas lying between the coils with a material having a high relative magnetic permeability with respect to the relative magnetic permeability of the second layer of bonding agent under the operating conditions at which power is transmitted between the electrical coils. The use of the magnetizable material having a relative magnetic permeability greater than the magnetic permeability of the bonding agent provides a higher magnetic permeability path for the lines of flux to follow in coupling the power from the stationary coils to the rotating coils. This decreases the lines of flux passing through the engine metal supports of both the primary and secondary coils and adjacent metal structures and reduces induced eddy currents and heating of these supports and structures by the eddy currents as compared with constructions in which a layer of bonding agent containing the coil does not contain a magnetizable material. The smaller eddy currents and the smaller amount of heating reduces the power loss and reduces the generation of heat. The heat that is generated is transferred by conduction to the rotating shaft and by convection to other components in contact with the oil. The transferred heat causes temperature gradients in the rotating shafts which are accompanied by thermal stresses adversely affecting the fatigue life of the shafts. In addition, the transfer of heat to the bonding agent causes temperature gradients which adversely affect the durability of both the first and second layer of bonding agents and causes carbonization of the oil. The transferred heat causes temperature rises which adversely affect the electrical life of the components. As compared with constructions in which the bonding agent might be made thicker to space the coils further from the metal supports to reduce the generation of eddy currents in the metallic support members, the present construction reduces the adverse impact of the weight of the bonding agent on engine operation and on the radial profile of the instrumentation. This is especially important because an engine which is not designed to use a rotor telemetry instrumentation system for a data communication link must be modified to accept a telemetry instrumentation package. In the particular embodiment discussed above, the engine was modified by removing a portion of the bevel gears as shown by the broken lines in FIG. 1. As will be realized this invention has application in an engine for which a rotor telemetry system is expressly designed for the engine as well as for an engine which is modified to accept the rotor telemetry system.

Although the invention has been shown and described with respect to preferred embodiments thereof, it should be understood by those skilled in the art that various changes and omissions in the form and detail thereof may be made therein without departing from the spirit and the scope of the invention.

I claim:

1. For a rotary machine of the type having a first member and a second member capable of rotational movement relative to each other, a device for transferring electrical energy between such members which comprises:

a first member;

a first electrical coil which is fixed to the first member and which is adapted to form with another coil a pair of coils for transferring electrical energy;

a second member which is spaced from the first member and which is capable of relative rotational movement with respect to the first member, the second member having a first layer of bonding agent, and, a second layer of a bonding agent which has a magnetizable filler material disposed therein and which extends between the first layer and the second member to attach the first layer to the second member; and a second electrical coil which is held by the first layer and which is adapted to form with the first electrical coil a pair of coils for transferring electrical energy;

wherein the magnetizable material has a magnetic permeability greater than the magnetic permeability of the bonding agent of the second layer and wherein the second layer affects the coupling of the magnetic flux linkages between said electrical coils and spaces said second coil away from the second member to reduce eddy currents in the second member.

2. The invention as claimed in claim 1 wherein the second electrical coil is disposed within said first layer of bonding agent.

3. The device for transferring electrical power of claim 2 wherein the first member is part of the stator structure of an axial flow gas turbine engine and the second member is a rotating shaft of the turbomachine and wherein the second layer of bonding agent is radially outwardly of the first layer of bonding agent.

4. The device for transferring electrical power of claim 1 which further includes a third layer of bonding agent which is adapted to be attached to the first member, and further includes a fourth layer of bonding material, wherein the first electrical coil is fixed to the third layer of bonding agent and the fourth layer of bonding agent extends between the third layer of bonding agent and the first member and wherein a magnetizable material having a magnetic permeability greater than the magnetic permeability of the fourth layer of bonding agent under operating conditions is disposed in the fourth layer of bonding agent to affect coupling of the magnetic flux linkages between the electrical coils.

5. The device for transferring electrical energy of claim 1, 3 or 4 wherein the coils are spaced radially one from another and a pair of antennas is disposed between the coils, each antenna being attached to an associated member and each being adapted to be in electrical communication with the other such that the coils supply electrical power to the pair of antennas to provide electrical communication between the antennas.

6. The device for transferring electrical energy of claim 1 wherein the magnetizable material has a relative magnetic permeability under operating conditions that is greater than twenty-five hundred (2500).

7. The device for transferring electrical energy of claim 5 wherein the bonding agent of the first layer is an epoxy resin containing a ceramic based filler of up to fifty percent (50%) by weight of the epoxy resin and the bonding agent of the second layer is an epoxy resin containing a ferrite filler of less than twenty-five percent (25%) by weight of the epoxy resin, the ferrite filler having a particle size of approximately three-thousandths of an inch (0.003 inches).

8. For a rotary machine of the type having a stator structure and a rotatable shaft, a device for transferring electrical energy between the shaft and the stator structure in the form of power and telemetry signals which comprises:

a first layer of bonding agent which is adapted to be attached to the rotatable shaft;

a second layer of bonding agent extending between the first layer of bonding agent and the rotatable shaft to attach the first layer to the shaft;

a first layer of bonding agent which is adapted to be attached to the stator structure;

a second layer of bonding agent extending between the first layer of bonding agent and the stator structure to attach the first layer to the stator structure;

a pair of electrically cooperating antennas, one disposed in the first layer on the shaft and one disposed in the first layer on the stator structure;

a pair of electrically cooperating coils, one disposed in the first layer on the shaft and one disposed in the first layer on the stator structure such that the coils radially bracket the antennas; wherein each of the second layers contains a filler formed of magnetizable material having a relative magnetic permeability under operating conditions that is greater than the magnetic permeability of the bonding agent to affect coupling of the magnetic flux linkages between the electrical coils and wherein the pair of coils are adapted to provide electrical power to the pair of antennas to enable electrical communication between the antennas.

9. For a rotary machine, a method for affecting the coupling of magnetic flux linkages during the transfer of electrical energy between an electrical coil mounted on a rotating member of the rotary machine and an electrical coil mounted on a stationary member of the rotary machine comprising:

disposing one of the electrical coils in a first layer of bonding agent;

attaching the first layer of bonding agent containing the electrical coil to one of said members with a second layer of bonding agent extending between the first layer of bonding agent and the member;

wherein the second layer of bonding agent has a filler of magnetizable material disposed therein having a relative magnetic permeability under operating conditions that is greater than the relative magnetic permeability of the bonding agent.

10. The method of affecting the coupling of magnetic flux linkages of claim 9 wherein the bonding agent of the second layer is an epoxy resin containing a ferrite filler of up to 25% by weight of the epoxy, the ferrite filler having a particle size of approximately three-thousandths of an inch (0.003 inches).

* * * * *

UNITED STATES PATENT AND TRADEMARK OFFICE

CERTIFICATE OF CORRECTION

PATENT NO. : 4,446,461

DATED : May 1, 1984

INVENTOR(S) : Franklin G. Selleck

It is certified that error appears in the above-identified patent and that said Letters Patent is hereby corrected as shown below:

Column 5, line 66: after "range" change "ratio" to "radio"

Signed and Sealed this

*Twenty-third* Day of *April 1985*

[SEAL]

*Attest:*

DONALD J. QUIGG

*Attesting Officer* *Acting Commissioner of Patents and Trademarks*